US012560029B2

(12) United States Patent
Delwiche et al.

(10) Patent No.: US 12,560,029 B2
(45) Date of Patent: Feb. 24, 2026

(54) ROCK-CUTTING TOOL AND METHOD FOR MINE AND OIL DRILLING

(71) Applicant: DIAROTECH S.A., Fleurus (BE)

(72) Inventors: Robert Delwiche, Uccle (BE); Etienne Lamine, Court-Saint-Etienne (BE)

(73) Assignee: DIAROTECH S.A., Fleurus (BE)

( * ) Notice: Subject to any disclaimer, the term of this patent is extended or adjusted under 35 U.S.C. 154(b) by 0 days.

(21) Appl. No.: 18/083,526

(22) Filed: Dec. 18, 2022

(65) Prior Publication Data

US 2023/0117211 A1 Apr. 20, 2023

Related U.S. Application Data

(63) Continuation of application No. 16/344,035, filed as application No. PCT/EP2017/078653 on Nov. 8, 2017, now abandoned.

(30) Foreign Application Priority Data

Nov. 14, 2016 (BE) ..... 2016/5854

(51) Int. Cl.
*E21B 10/573* (2006.01)

(52) U.S. Cl.
CPC ..... *E21B 10/5735* (2013.01)

(58) Field of Classification Search
CPC ..... E21B 10/573; E21B 10/5735
See application file for complete search history.

(56) References Cited

U.S. PATENT DOCUMENTS

| | | | | |
|---|---|---|---|---|
| 4,525,178 | A * | 6/1985 | Hall | F16C 33/26 51/293 |
| 6,394,202 | B2 | 5/2002 | Truax | |
| 8,851,208 | B2 * | 10/2014 | Scott | B24D 18/0009 175/434 |
| 2006/0081402 | A1 * | 4/2006 | Lockwood | C22C 26/00 175/434 |
| 2010/0126779 | A1 | 5/2010 | Corbett | |
| 2012/0222364 | A1 * | 9/2012 | Lyons | E21B 10/5735 51/296 |
| 2014/0223836 | A1 * | 8/2014 | Shen | C23F 1/02 51/307 |
| 2014/0298728 | A1 * | 10/2014 | Keshavan | B24D 3/10 51/306 |
| 2014/0311045 | A1 * | 10/2014 | Davies | B24D 18/0009 51/309 |
| 2015/0068813 | A1 | 3/2015 | Moreno, II | |

* cited by examiner

*Primary Examiner* — Yanick A Akaragwe
(74) *Attorney, Agent, or Firm* — Maschoff Brennan

(57) ABSTRACT

The invention relates to a rock-cutting tool and a method for manufacturing this tool, which comprises knives comprising a layer of polycrystalline synthetic diamond (PSD), a diamond impregnation layer with diamond particles and bonding cobalt, characterized in that the PSD layer is supported directly, along a planar interface, on the diamond impregnation layer whose interface surface is planar by machining and with which the diamond particles are flush.

5 Claims, 4 Drawing Sheets

ROCK-CUTTING TOOL AND METHOD FOR MINE AND OIL DRILLING

The present invention relates to rock-cutting tools for mine and oil drilling as well as the method for manufacturing them.

Mine or oil drillers have long used tricone-type tools, called "rockbits", i.e., having a cutting head comprising three conical rotary heads, provided with teeth or spurs to drill any type of terrain more or less effectively. During the vertical progression of the drilling tool, the tricone was changed to adapt to the nature of the encountered formation, i.e., the hardness of the rock. Indeed, oil deposits are often found at a depth of several thousand meters, and it is necessary to traverse a series of soft rock, such as clay, and hard rock, such as sandstone, to access them. In the 1960s, the development of polycrystalline synthetic diamonds (PSD) and their incorporation into drilling tools to replace teeth and spurs made it possible to drastically improve drilling efficiency, in particular in softer rock, and led to the abandonment of "rockbit" tools.

In practice, PSD knives were manufactured comprising a very impact resistant support layer, generally with a base of tungsten carbide (WC), on which a thinner layer of PSD was formed, using a high pressure-high temperature (HPHT) or chemical vapor deposition (CVD) method. These knives are incorporated by brazing into the rotary cutting heads, or blades, of drilling tools, which may have varied shapes.

However, these PSD knives have several drawbacks. On the one hand, the wear resistance of the PSD layer depends greatly on the layer that bears it. The major difference in thermal expansion coefficient between the PSD (low coefficient) and the carbide support (high coefficient) causes a mechanical stress that is particularly high at a high temperature. Yet during drilling, the temperatures reach several hundred degrees at the cutting head. This may cause cracks to form in the PSD layer and significantly reduce its longevity. Furthermore, the low abrasion resistance of the support layer and an elasticity of the rock cause striking and greatly limit its support action for the PSD, which will break under the action of the mechanical stress. These drawbacks therefore reduce the application of PSD to soft formations.

It was then proposed, to strengthen the blades, to add, on the rotary drilling heads, in the thickness of the blades, diamond-impregnated knives, i.e., drill bits, impregnated in their structure, generally with a carbide base, with a multitude of diamond particles. These diamond-impregnated knives are manufactured using powder metallurgy methods and are much more abrasion-resistant than a simple carbide-based structure, each diamond particle participating in the abrasion of the rock. The combination of these diamonded knives and PSD knives in so-called mixed tools did not, however, allow a significant improvement in the drilling capabilities of the tool. Indeed, for reasons related to the brazing techniques, the diamonded knife is too far away from the PSD layer and therefore does not allow effective reinforcement of its action. In the presence of a hard formation layer, the PSD layer wears out before the diamonded knife can be truly effective, and it is therefore no longer available for a softer successive layer. Yet it is extremely lengthy and costly to remove a cutting head from drilling in order to replace the tool.

The applicant has therefore sought to develop rock-cutting tools having blades making it possible to drill effectively both in soft formations and hard formations, with minimal wear. It is the aim of the present invention to propose a hybrid rock-cutting tool, effective and strong, as well as a method for manufacturing this tool.

Solution of the Invention

To this end, the invention relates to a rock-cutting tool with knives comprising at least one front layer of polycrystalline synthetic diamond (PSD), a rear diamond impregnation layer with diamond particles and bonding cobalt, characterized in that the PSD layer is supported directly, along a planar interface, the diamond impregnation layer whose interface surface is planar by machining and with which the diamond particles are flush, and the diamond particles flush with the impregnation layer are covalently bonded with the polycrystalline synthetic diamond.

In one interesting embodiment, it is provided to alternate diamond impregnation layers and PSD layers.

US2014/0023839 describes knives having a front PSD layer bearing on a rear diamond impregnation layer with diamond particles comprising bonding cobalt. However, the interface between these two layers is not planar, and no diamond particle is flush with the surface of the diamond impregnation layer. The cohesion between the two layers is based on the non-flatness of the interface, which increases the surface area of this interface.

In the knives of the tool according to the present invention, the cohesion between the two layers is done by carbon-carbon covalent chemical bonds, the PSD layer is as if set in the diamond impregnation layer, which significantly increases the adhesion between the two layers and makes the tool more resistant to the mechanical stresses resulting either from the direct contact with the rock, or the high temperatures that may be encountered under drilling conditions.

The present invention also proposes a method for manufacturing a knife of a rock-cutting tool according to which

- diamond pellets are prepared with a powder containing tungsten, carbon and cobalt,
- a diamond impregnation layer is preformed by cold pressing pellets in a mold,
- the preformed diamond impregnation layer is sintered to set the diamonds,
- the sintered diamond impregnation layer is machined until obtaining a planar surface with flush diamonds,
- a layer of diamond powder is deposited on said planar surface, and
- the layer of diamond powder is converted into a layer of polycrystalline synthetic diamond (PSD) covalently bonded to said flush diamonds.

Advantageously, each pellet contains only one diamond particle.

In one embodiment of the inventive method, the sintering of the diamond impregnation layer is done by a hot isostatic method.

It is clear that the tool according to the invention and the method for manufacturing a knife, intermediate product of the tool, are connected by an inventive concept, due to their same essential features intended to resolve the same problem.

The invention will be better understood using the following description of several embodiments of the invention, in reference to the appended drawing, in which.

Figure 1:
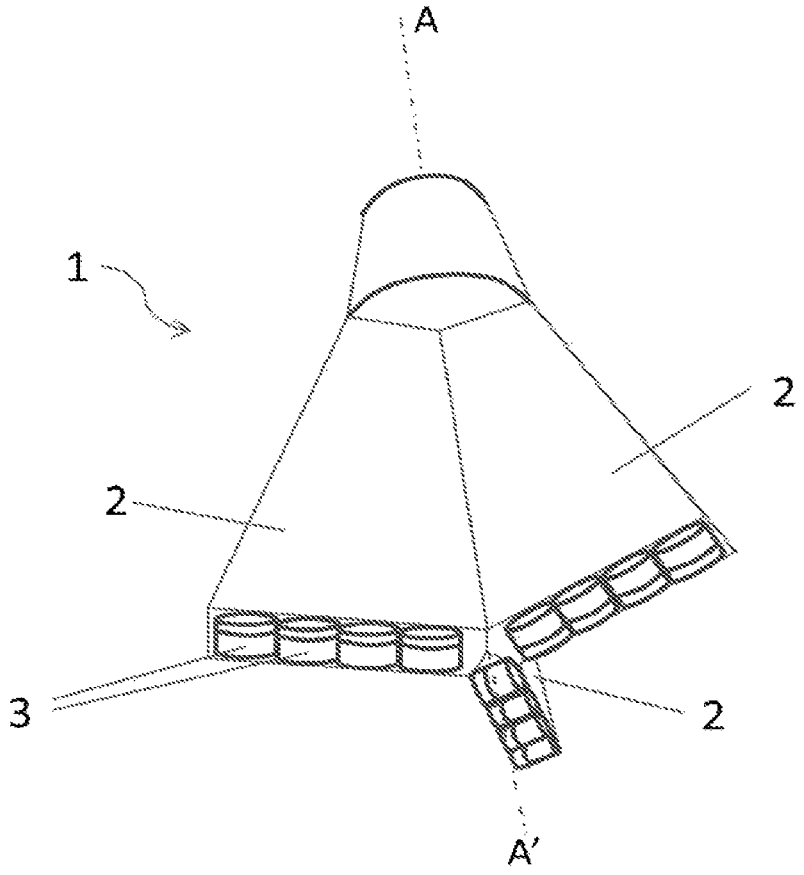
FIG. 1 is a perspective schematic view of the tool according to the invention.
Figure 2:
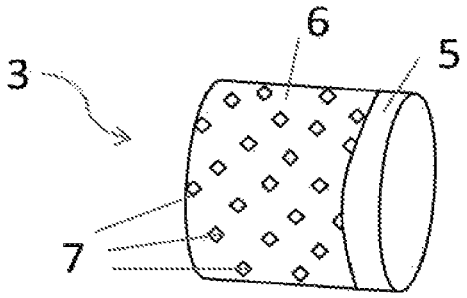
FIG. 2 is a perspective view of a knife of the tool of FIG. 1.
Figure 3:
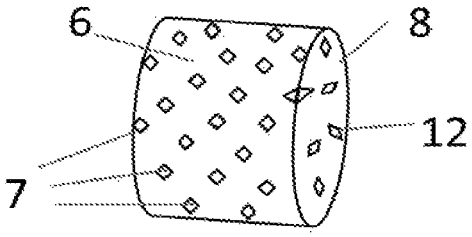
FIG. 3 is a perspective view of the diamond impregnation layer of the knife of FIG. 2.

In reference to FIG. 1, a rock-cutting tool 1 has three blades 2 with four knives 3 at the free end of each blade. The tool 1 is intended to be rotated around its axis AA'. In reference to FIG. 2, each knife is made up of a front or forward layer 5 made from polycrystalline synthetic diamond (PSD) and a back or rear diamond impregnation layer 6 with diamond particles 7. In reference to FIG. 3, the front surface 8 of the rear layer 6, adjacent to the front layer 5, is planar and diamond particles 12 are flush therewith.

Oil drilling uses tools that dig a cylindrical hole. The tools used generally have a cutting head that rotates at a faster or slower speed in one direction. The tool 1 has three blades 2 that will be in contact with the rock formation to be drilled. In particular, the knives 3 will provide drilling of the rock formation.

The PSD layer 5 is very hard and forms the cutting edge that will first cut the rock formation. This layer 5 is, however, relatively brittle and is supported by a layer that is more resistant to mechanical stress.

Typically, a tungsten carbide support layer is used as a support, this material having excellent resistance to mechanical stress. However, tungsten carbide does not withstand abrasion well and wears out quickly in contact with rock, which reduces the lifetime of the PSD layer. Although a priori less resistant to mechanical stress, due to its biphasic nature, the diamond impregnation layer 6 here is used to support the PSD layer 5, which has at least two advantages: the diamond particles 7 present in a tungsten carbide matrix, also containing cobalt to guarantee the bonding of the assembly, increase the abrasion resistance of the support and actively participate in the drilling of the rock, on the one hand, and on the other hand, the presence of these diamond particles makes it possible to reduce the difference in thermal expansion coefficient between the support layer 6 and the PSD layer 5, which limits the mechanical stress that appears when the tool heats up to several hundred degrees during its rotation in contact with the rock. This results in a certain improvement in the lifetime of the tool.

The method used to manufacture knives 3 makes it possible to give them other advantageous properties.

Figure 4:
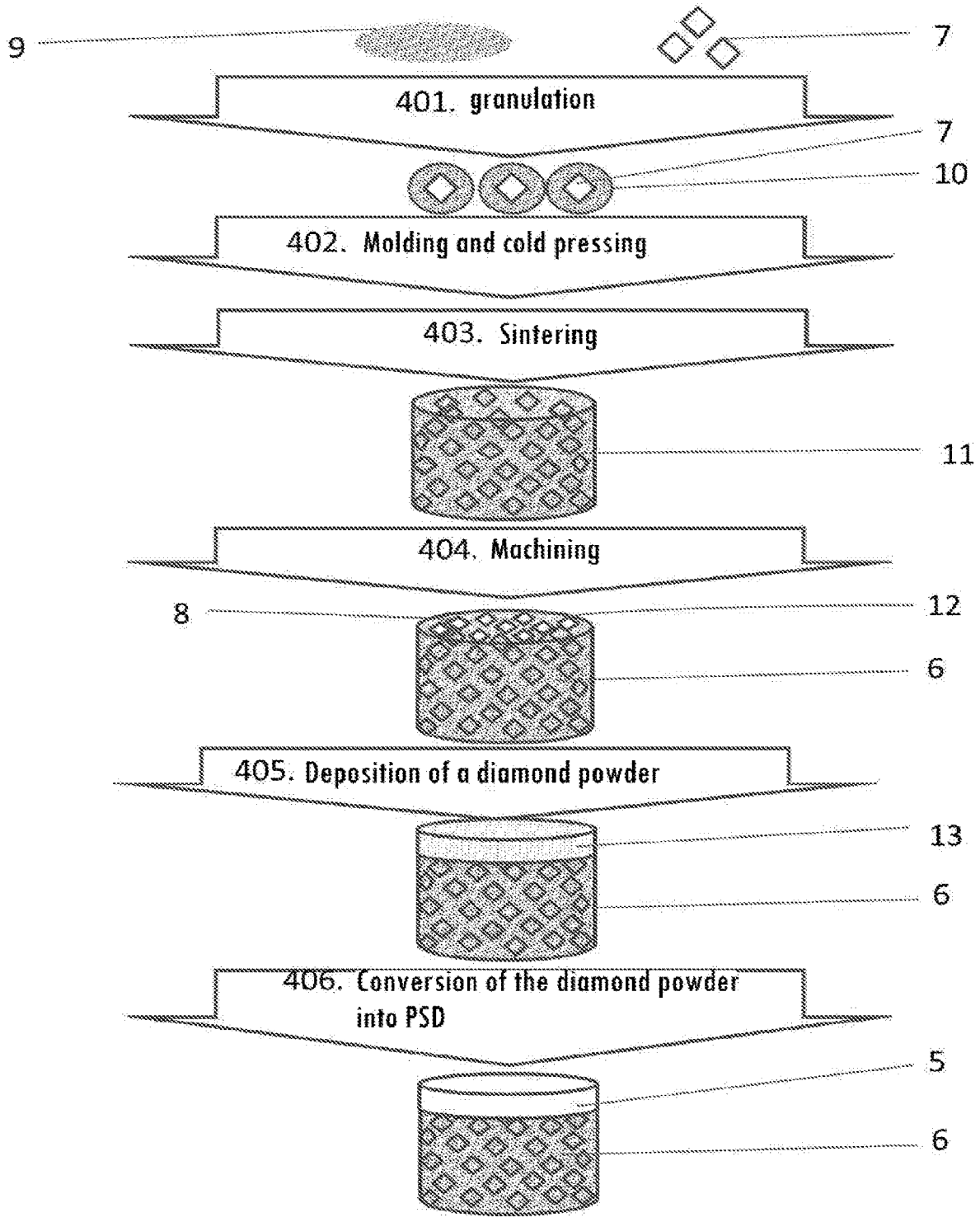
FIG. 4 is a flowchart that schematically illustrates the method of the invention.

In reference to FIG. 4, step 401 for granulating a powder 9 with diamond particles 7 results in diamond pellets 10 that are next molded and cold-compressed in step 402 for preforming the diamond impregnation layer. This preformed layer is next subjected, in step 403, to sintering, at the end of which a diamond impregnation layer 11 is obtained. This layer 11 is next machined in step 404 until the surface 8 is made planar so as to expose flush diamond particles 12 therein. A layer of diamond powder 13 is deposited on the surface 8 in step 405, then a step 406 allows the conversion of the diamond powder 13 into a polycrystalline synthetic diamond 5.

The powder 9 used in step 401 comprises carbon, tungsten and cobalt. The granulation is done such that each diamond particle 7 is coated in a tungsten carbide matrix, the cobalt serving as binder, and even such that each pellet 10 contains only one diamond particle 7. The choice of the starting size of the diamond particles 7, as well as filtering tools subsequently used, determines the size of the pellets 10. The use of such pellets 10 makes it possible to obtain an excellent homogeneity of the distribution of the diamond particles 7 in the entire diamond impregnation layer 11. These particles 7 could even not touch one another, i.e., the average distance between two diamond particles 7 would be constant in the entire impregnation layer 11.

These pellets 10 are introduced into a mold, the shape of which corresponds to the desired shape of the diamond impregnation layer 11, then cold-compressed to preform this layer 11. The diamond impregnation layer is therefore a layer of tungsten carbide, containing cobalt, and in which diamond particles are distributed homogeneously.

The sintering step 403 consists of heating the powder 9 containing the carbon and the tungsten making up the pellets 10 without melting these elements. The heat makes it possible, however, to melt the cobalt, which is also present therein, in order to weld/bond all of the elements to one another. The cobalt plays a binding role here. Sintering techniques are well known in powder metallurgy. It is for example possible to carry out sintering by hot isostatic compression in a gaseous atmosphere (hipping), which makes it possible to obtain a dense layer 11, setting the diamond particles 7 in a reinforced way.

At this stage, the diamond particles 7 having been introduced in the form of "encapsulated" pellets, the surfaces of the impregnation layer 11 expose only tungsten carbide and cobalt. Before forming the PSD layer 5 on one of these surfaces, a machining step 404 is carried out in order to planarize this surface 8 and in order to make the diamond particles 12 set in the diamond impregnation layer 6 flush. The machining can for example be done by grinding or laser.

The machined diamond impregnation layer 6 can then be placed back in an appropriate mold where the diamond powder 13 is deposited on the machined face 8 of the layer 6 and where this diamond powder 13 is converted into PSD 5.

The conversion of the diamond powder 13 into a PSD layer 5 consists of forming covalent chemical bonds between carbon atoms coming from different diamond particles making up this powder 13, i.e., bonds that will weld the particles of the powder to one another to form a single so-called "polycrystalline" element. In this step, there is no addition of carbon, therefore no new diamond formation, but the bonding of a multitude of diamond particles to one another. This conversion generally takes place at a high temperature and requires a catalyst element, here cobalt. Cobalt can therefore be added to the diamond powder 13 to facilitate the reaction. This is not, however, necessary here, the pressure and temperature conditions used in the conversion step 406 being such that the cobalt contained in the diamond impregnation layer 6 can migrate toward the surface 8 and be used as a conversion catalyst 406. The cobalt used as binder in step 403 here plays a second role, that of catalyst. The homogeneity of the diamond impregnation layer 6 may be interesting to allow a homogeneous migration of the cobalt toward the entire surface where the diamond powder 13 has been deposited, in order to ensure the formation of a PSD that is also homogeneous and solid.

The conditions necessary for the conversion of step 406 are for example obtained by a high pressure-high temperature (HPHT) method that is well known in powder metallurgy.

During this conversion, not only will the particles of the diamond powder 13 bond to one another, but the bonds will also be able to form between the particles of the diamond powder 13 and the flush diamond particles 12 of the impregnation layers 6. The PSD layer 5 will therefore by very strongly moored to its support layer 6, owing to the machining layer that has made it possible to create flushness at the interface 8 between the two layers of diamond particles 12.

This gives the entire knife an additional resistance to mechanical stress, the PSD layer 5 not tending to separate from its support layer 6 under the effect of impacts or the increase in temperature during drilling. The lifetime of the tool is therefore significantly improved, as is its effectiveness faced with a wide variety of rock formations, both soft and hard.

Figure 5:
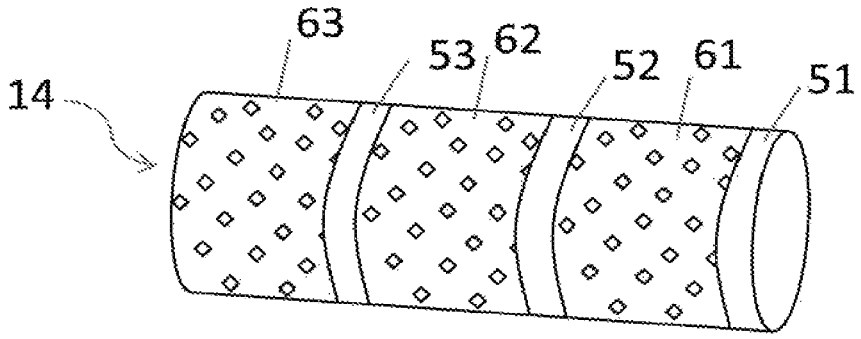
FIG. 5 is a perspective view of an alternative embodiment of a knife of the tool according to the invention.

Depending on the depth to be drilled as well as the nature of the rocks that will be encountered, the shape of the tool may be varied, as well as the shape and number of its blades. In some cases, it can be interested to use multi-layer blades 14 (FIG. 5), i.e., associated several alternating diamond impregnation layers, here the three layers 61, 62 and 63 with several PSD layers 51, 52 and 53.

The method for manufacturing these multi-layer knives 14 reiterates the same steps 401 to 406 previously described. Some of these steps can be multiplied. For example, the diamond impregnation layer 61 is machined on both of its contact faces with the PSD layers 51 and 52. The diamond impregnation layer 62 is also machined on both of its contact face with the PSD layers 52 and 53. Still more generally, the diamond impregnation layer can be machined on several faces until obtaining planar surfaces with flush diamonds.

In this multi-layer configuration, the PSD layers 52 and 53 are each supported on either side by two impregnation layers, which further strengthens their impact resistance. Each knife than has several cutting edges.

The knives described here have a cylindrical shape. It is nevertheless possible, depending on the configuration of the tool, to manufacture knives having various shapes that are more or less complex. The manufacturing method described here can use a wide variety of molds depending on the needs.

The invention claimed is:

1. A method for manufacturing a knife of a rock-cutting tool, the method comprising:

preparing a mix of diamonds particles and a powder comprising carbon, tungsten, and cobalt;

cold pressing the mix in a mold to pre-form a diamond impregnation layer;

sintering the preformed diamond impregnation layer to create a sintered diamond impregnation layer having a homogenous distribution of the diamond particles therein, wherein the cobalt in the layer serves as binder in the sintering process;

mechanically machining the sintered diamond impregnation layer until obtaining a machined planar surface revealing the diamond particles which are flush with the machined planar surface;

depositing a layer of diamond powder onto the machined planar surface of the impregnation layer having the revealed diamond particles which are flush with the machined planar surface; and at a high temperature, converting the diamond powder into a polycrystalline synthetic diamond (PSD) layer having covalent chemical bonds between carbon from the layer of diamond powder and the revealed diamond particles which are flush with the machine planar surface of the sintered diamond impregnation layer, and wherein the homogeneity of the sintered diamond impregnation layer allows a homogeneous migration of the cobalt toward the entire surface where the diamond powder has been deposited on the machined surface; wherein the cobalt in the impregnation layer further serves as catalyst to carbon-carbon bond formation during diamond formation.

2. The method of claim 1 wherein:

machining the surface comprises either grinding or laser.

3. The method according to claim 1 wherein:

the sintering of the diamond impregnation layer is done by a hot isostatic method.

4. The method according to claim 1 wherein:

the conversion of the layer of diamond powder into a PSD layer is catalyzed by cobalt.

5. The method according to claim 1 wherein:

the diamond impregnation layer is machined on at least one face until obtaining diamond particles that have a planar surface.

* * * * *